US005356011A

United States Patent [19]

Romick

[11] Patent Number: 5,356,011

[45] Date of Patent: Oct. 18, 1994

[54] MEDICATION DISPENSING CONTAINER

[76] Inventor: Jerome M. Romick, Artromick International, Inc., 4800 Hilton Corp. Dr., Columbus, Ohio 43232

[21] Appl. No.: 35,085

[22] Filed: Mar. 22, 1993

Related U.S. Application Data

[63] Continuation-in-part of Ser. No. 970,863, Nov. 3, 1992, Pat. No. 5,299,711.

[51] Int. Cl.[5] ..... B65D 83/04

[52] U.S. Cl. ..... 206/534; 221/2; 40/642

[58] Field of Search ..... 221/2; 206/534, 538, 206/459.5; 215/365, 367; 40/642, 611, 653, 312; 222/23; 312/234, 234.3

[56] References Cited

U.S. PATENT DOCUMENTS

| | | | |
|---|---|---|---|
| D. 165,856 | 1/1952 | Mytinger | D9/341 |
| D. 281,145 | 11/1985 | Moe | D9/341 |
| 828,151 | 8/1906 | Upjohn | 220/351 |
| 2,035,340 | 3/1936 | Primavera | 220/345 |
| 2,101,687 | 12/1937 | Paul | 206/538 |
| 2,102,094 | 12/1937 | Romig | 220/41 |
| 2,295,747 | 9/1942 | Mills | 220/41 |
| 2,378,003 | 6/1945 | Duell | 206/538 |
| 2,463,586 | 3/1949 | Anderson | 220/351 |
| 2,708,026 | 4/1955 | Duell | 206/42 |
| 2,777,570 | 2/1957 | Mytinger | 206/42 |
| 2,967,366 | 1/1961 | Colbert | 40/642 |
| 3,082,902 | 3/1963 | Kimbrough, Jr. | 220/18 |
| 3,537,422 | 4/1970 | Moe | 220/525 |
| 3,817,372 | 6/1974 | Smith | 220/525 |
| 4,128,955 | 12/1978 | Marra et al. | 40/642 |
| 4,342,403 | 8/1982 | Badtke et al. | 206/540 |
| 4,360,148 | 11/1982 | Forbes, Jr. | 220/351 |
| 4,418,823 | 12/1983 | Romick | 206/538 |
| 4,535,890 | 8/1985 | Artusi | 206/532 |
| 4,569,462 | 2/1986 | Belolin | 222/180 |
| 4,615,461 | 10/1986 | Liu | 220/331 |
| 4,947,989 | 8/1990 | Horton | 206/387 |

FOREIGN PATENT DOCUMENTS

| | | | |
|---|---|---|---|
| 36009 | 12/1929 | France | 40/642 |

*Primary Examiner*—Kenneth W. Noland

*Attorney, Agent, or Firm*—Vorys, Sater, Seymour and Pease

[57] ABSTRACT

A medical dispenser is disclosed having a container with a cover slidable with respect to the container wherein the cover has recessed areas for removably receiving appropriately sized and shaped tabs of an indicia bearing card and wherein the cover structure prevents sheetlike edges of material in the container from entering the recessed areas.

5 Claims, 4 Drawing Sheets

MEDICATION DISPENSING CONTAINER

CROSS-REFERENCE TO RELATED APPLICATION

The present application is a continuation-in-part application of U.S. patent application Ser. No. 07/970,863; filed Nov. 3, 1992; entitled: "Medication Dispensing Container" by Jerome M. Romick, now U.S. Pat. No. 5,299,711.

BACKGROUND OF THE INVENTION

The present invention relates generally to dispensers and, more particularly, to medication and pharmaceutical containing dispensers having improved indicia carrying capabilities and sliding characteristics.

The prior art contains a wide variety of medical dispensers for tablets, pills and other pharmaceutical preparations. One common type of dispenser construction includes a tray having a generally rectangular configuration dimensioned for storing a plurality of tablets and/or other medical preparations, and a slidable cover cooperating with guideways formed by the tray. Exemplary of such known dispensers are those described in U.S. Pat. Nos.: 828,151; 2,035,340; 2,101,687; 2,102,094; 2,378,003; and 2,777,576. Generally, slidable covers of this type have labels adhesively applied thereto which provide information regarding the contents of the tray and the patient to whom the contents are to be administered. None of the previously existing trays include means for allowing easy insertion, removal, and securement of indicia cards bearing the desired medical information.

SUMMARY OF THE INVENTION

The present invention provides an improved medical dispenser for storing and dispensing medical preparations. Included in this dispenser is a container formed as a tray having an open top, and guiding surfaces formed longitudinally at least along opposing marginal sides adjacent the open top. A covering means, is constructured so that it slidably cooperates with the tray guide surfaces for facilitating opening and closing of the covering means. The slidable covering means is provided with a pair of longitudinally spaced apart recess defining means which define recesses that are oriented with respect to each other and which are adapted to releasably receive opposed end portions of a pliable indicia bearing card member. In the illustrated embodiment, the covering means includes means for preventing sheetlike edges of package material contained within the dispenser from entering the card receiving recesses.

In an illustrated embodiment, the preventing means includes a plurality of spaced apart ribs which extend longitudinally across and within each recess.

Accordingly, among the objects which are provided by the present invention are the following: an improved medical dispensing container which has improved indicia carrying capabilities; an improved dispensing container which allows for easy, insertion, retention, and replacement of indicia bearing cards on a slidable cover so as to facilitate reuse of the dispenser; an improved slidable cover of such a dispenser which prevents sheetlike edges of material in the dispenser from being caught in the cover apertures, which apertures receive the indicia bearing card; and, an improved indicia bearing card having a plurality of laterally spaced tabs at each end for cooperation with receiving apertures.

Other objects and further scope of applicability of the present invention will become apparent from the detailed description to follow when taken in conjunction with the accompanying drawings in which like parts are designated by like reference numerals throughout the several views.

DETAILED DESCRIPTIONS

Figure 1:
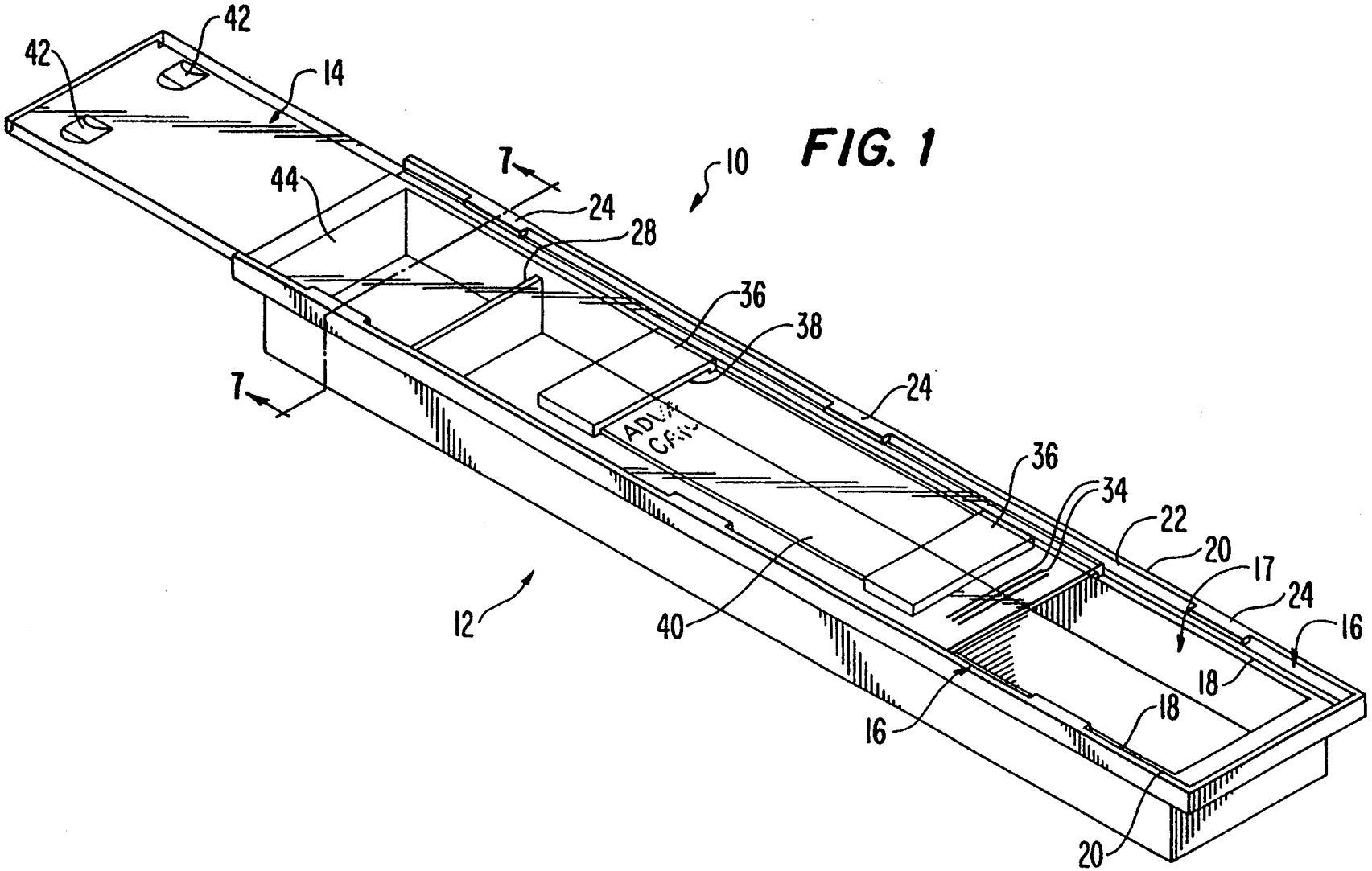
FIG. 1 is a perspective view of a medical dispenser according to the present invention.
Figure 2:
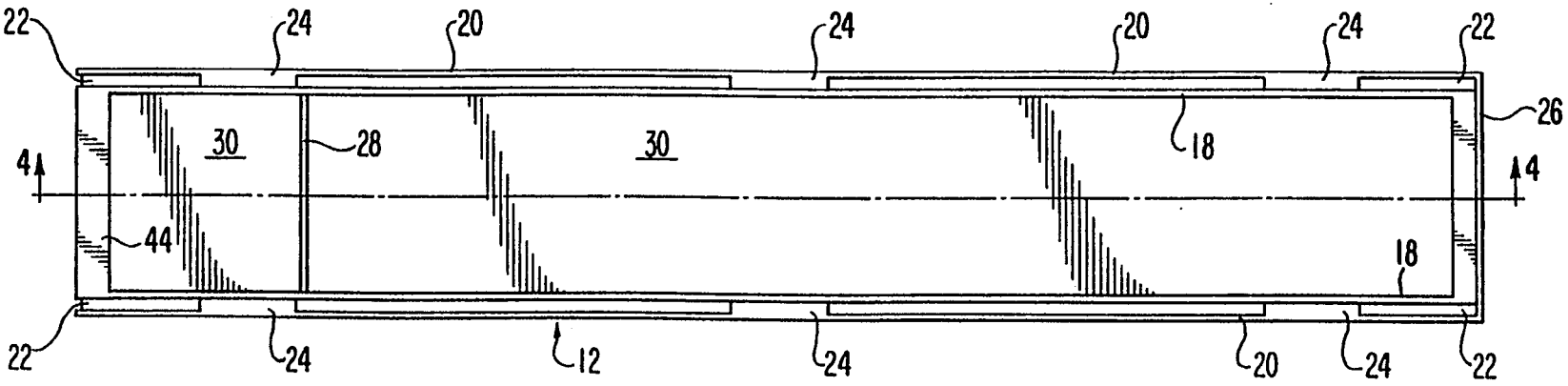
FIG. 2 is a plan view of a tray type container according to the present invention.
Figure 3:
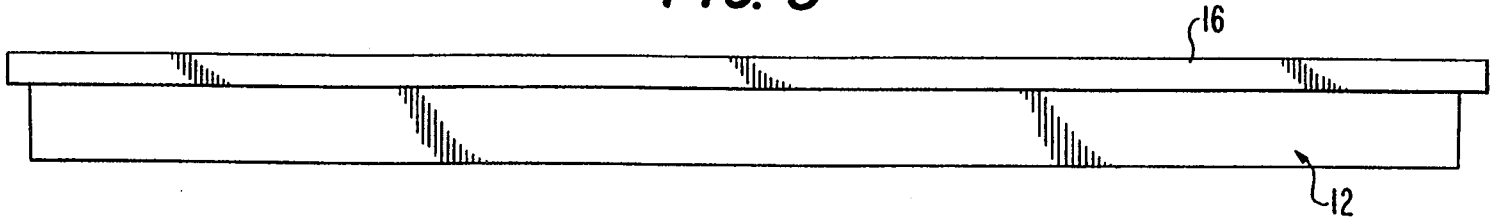
FIG. 3 is a side elevational view of the container of FIG. 2.
Figure 4:
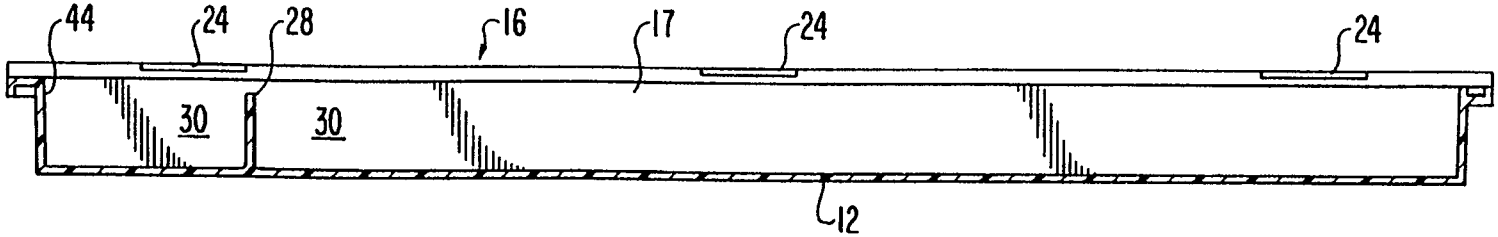
FIG. 4 is a cross-sectional view taken along the section line 4—4 appearing in FIG. 3.
Figure 5:
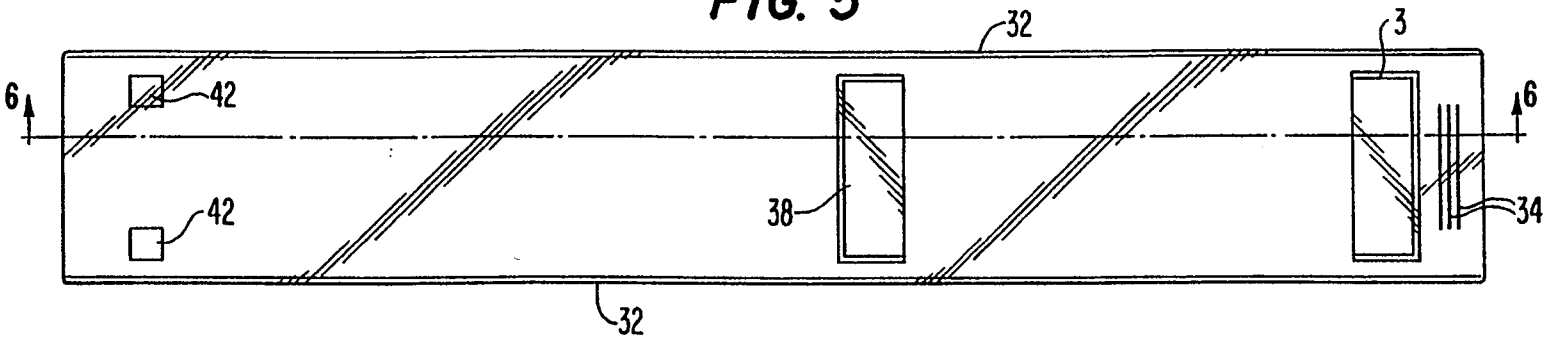
FIG. 5 is a plan view of a slide cover made according to the present invention.
Figure 6:
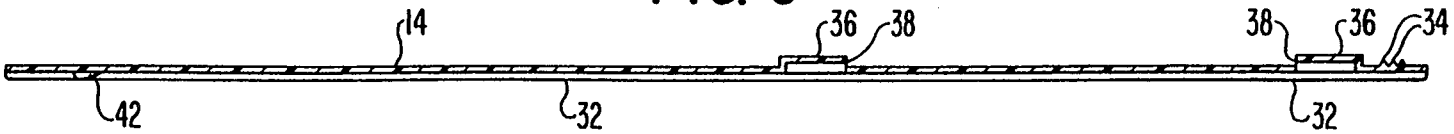
FIG. 6 is a cross-sectional view of the slide cover taken along the section line 6—6 appearing in FIG. 5.
Figure 8:
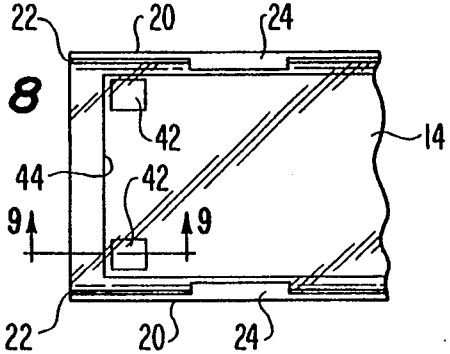
FIG. 8 is a fragmented end view of the dispenser.
Figure 9:
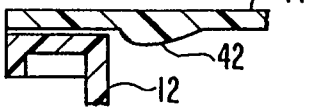
FIG. 9 is a cross-sectional view taken along section line 9—9 appearing in FIG. 8.

FIGS. 1–9 illustrate one embodiment of an improved medical dispenser 10 made in accordance with the principles of the present invention. As illustrated in FIGS. 1–4 and 7, the dispenser 10 includes a tray type container 12 and a cover 14 slidably cooperable with the container. The container 12 is formed of a suitable plastic material and is constructed in an elongated, generally parallelpiped construction. The container 12 includes guide or channel means 16 integrally formed along opposite longitudinal edges thereof, and defines an open top portion 17 which allows insertion and removal of the medical preparations (not shown). Each of the channel means 16 includes a pair of spaced apart inner and outer parallel walls 18, 20 which define a corresponding longitudinal channel 22. The outer channel walls 20 are raised relative to the inner channel walls 18 and are formed with a plurality of spaced cover retaining tabs 24. The tabs 24 are spaced over the channels 22 and cooperate with the sliding cover 14 for inhibiting removal of the latter. As best seen in FIGS. 1 and 2, each of the respective cover mounting channels 22 terminate in a retaining wall 26 which is constructed to limit inward sliding movement of the cover 14 relative to the container 12. The channels 22 are also formed with mouth portions which define an end which permits entry and removal of the cover relative to the container. The channels 22 are internal and therefore in contrast to previously known trays are not susceptible to bending or distortion which otherwise might interfere with an easy sliding movement of the cover.

The container 12 is provided with at least one partition 28 which defines separate storage chambers 30 within the container 12 that are adapted to receive tablets or other medical preparations that are (not shown) to be carried by the dispenser 10. The container 12 can be provided with a plurality of such partitions or other constructions.

Figure 7:
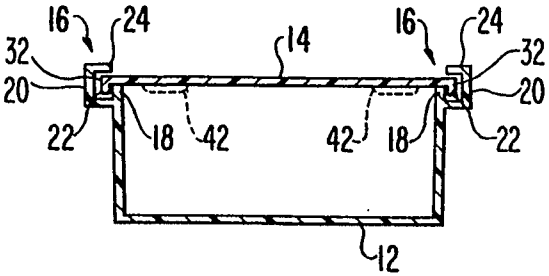
FIG. 7 is a cross-sectional end view taken along section line 7—7 appearing in FIG. 1.

Reference is now made to FIGS. 1 and 5–9 which illustrate the cover 14. In this embodiment, the cover 14 is in the form of a unitary, generally flat, and rectangular member made of transparent plastic and having a pair of depending edge means. Each edge means defines an integral depending lip portion 32 which is adapted to be slidably received within a channel 22 (FIG. 7). One end of the cover 14 is provided with a plurality of raised finger engaging projections 34 which facilitates the opening and closing of the cover 14. The cover 14 is provided with a pair of opposed raised projections 36 having apertures 38 therein which are generally facing each other. These raised projections 36 are intended to removably receive therein and retain a bendable or pliable, indicia bearing card 40 (FIG. 1) or the like which has opposite ends with tabs that are sized and shaped to be removably received by the recesses or apertures 38. The indicia card 40 when flexed in the middle can easily be inserted and removed from the cover. This facilitates reuse of the dispenser for a multiplicity of patients.

With continued reference to FIGS. 1 and 5–9, the cover 14 is provided with a pair of detents 42 protruding from a bottom surface of the cover. The detents 42 are for engaging a rear wall portion 44 of the container 12 so as to limit opening movement of the cover 14 until the former are forced to ride over the wall portion 44.

Figure 10:
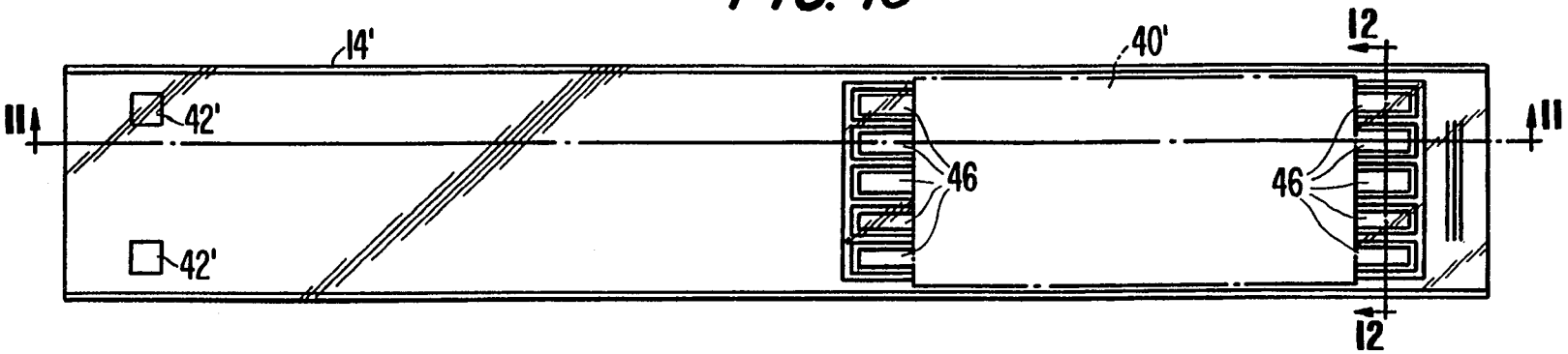
FIG. 10 is a plan view of an improved lid according to the invention.
Figure 11:
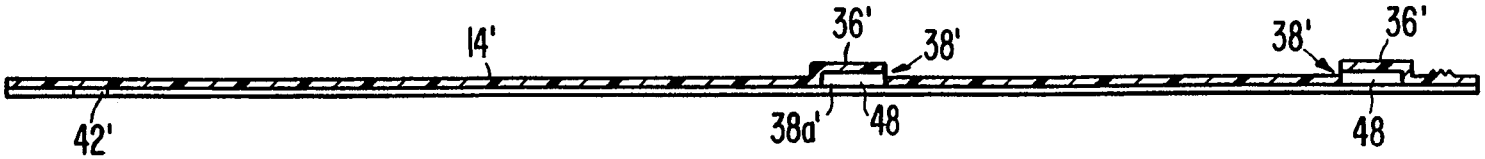
FIG. 11 is a cross-sectional view taken along section line 9 appearing in FIG. 10 looking in the direction of the arrows; and, FIG. 12 is a cross-sectional view taken along section line 12—12 appearing in FIG. 10.
Figure 12:
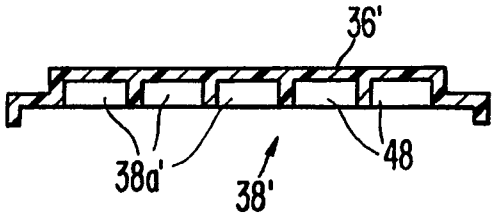

Reference is now made to FIGS. 10–12 which illustrate a preferred embodiment of the present invention. The structure of this embodiment which is similar to the previous described embodiment will be designated by like reference numerals with, however, the addition of a prime marking. Essentially, this embodiment differs from the foregoing insofar as it includes a structural approach for removably securing the indicia bearing card 40' in a manner which prevents edges of sheetlike edges, such as edges of tablet strips positioned within the dispenser from being caught in the apertures 38' during sliding of the cover 14' and causing the latter to otherwise jam or cause problems. In this particular embodiment, the indicia bearing card 40' includes at opposite ends thereof a plurality of laterally spaced apart and rectangular shaped tabs 46 which are sized and shaped for purposes to be evident. In this embodiment, the cover 14' is similarly formed as a unitary, generally flat, and rectangular member made preferably of transparent plastic. The cover 14' has a pair of depending longitudinal extending edge means which define lip portions 32' that are adapted to be slidably received within respective channels 22'. In this embodiment, the opposed raised projections 36' have a plurality of card receiving apertures or recesses 38'. The recesses 38' are generally longitudinally spaced from each other by a distance sufficient to enable the indicia bearing card 40' to be flexed so as to be conveniently inserted within the recesses 38' whereby when the card unflexes it serves to secure the indicia bearing card 40' during general use. The recesses 38' also define a plurality of recesses areas **38*a'* into which the tabs 46 on the card 40' are received. In this regard, the cover 14' is formed with a plurality of integral, longitudinally extending and laterally spaced apart ribs 48 which extend within and across each recess 38' as shown in FIGS. 10–12. The ribs 48 are sufficiently laterally spaced apart as shown so as to accommodate the tabs 46. The ribs 48 function to prevent or obstruct the potential entry of sheets of papers or edges of sheetlike material, such as unit dosage forms or their containers, stored within the container from getting caught in the recesses 38', if such ribs were not present, such as when the cover is slid between covering and non-covering positions. Each rib 48 has a bottom surface that is generally flush with respect to a bottom surface of the cover 14' so as to minimize the possibility of edges of material, such as prescription medication packages from otherwise catching on the ribs 48**.

While this particular embodiment discloses the utilization of a plurality of laterally spaced and longitudinally extending ribs located within the recesses for preventing edges of sheetlike material from becoming caught or wedged in the recesses 38', it will be appreciated that other structural configurations can be utilized consistent with the principles of this particular invention.

Certain changes may be made in the above described dispenser without departing from the scope of the invention involved, and it is intended that all matter contained in the description thereof or shown in the accompanying drawings be interpreted as illustrative and not in a limiting sense.

What is claimed is:

1. A dispenser for storing and dispensing medical preparations, comprising:

a container having a tray construction with an open top portion, said container being adapted to store and dispense medical preparations and including guide means formed at least along opposing marginal longitudinal sides thereof which are positioned adjacent said open top portion; and, slidable covering means for covering and uncovering said container, said covering means having edge means for slidably cooperating with said guide means so as to enable said covering means to slidably move between covering and non-covering positions with respect to said container;

said covering means including a pair of generally longitudinally spaced apart and opposing recess means for defining recesses into which opposed cooperating end portions of a pliable indicia bearing member may be inserted, secured, and replaced with another of such indicia bearing members;

each of said recess means including entry preventing means for obstructing the entry of unit dosage forms or their containers into a bottom opening in said recess means.

2. The dispenser of claim 1 wherein each of said entry preventing means includes a plurality of laterally spaced apart members positioned and oriented adjacent each of said recesses so as to define separate and adjacent recessed areas, each one of said recessed areas adapted to receive a separate tab portion of a plurality of such tab portions that are formed at respective end portions of said indicia bearing member.

3. The dispenser of claim 2 wherein said laterally spaced apart entry preventing members are defined as ribs integral with said covering means and positioned within each of said recesses.

4. The dispenser of claim 3 wherein said ribs have a bottom surface which is generally flush with a bottom surface of said covering means.

5. The dispenser of claim 2 wherein said pliable indicia bearing member has opposing end portions, each of said end portions being provided with a plurality of laterally spaced tab portions, each of said portions being configured and dimensioned to be removably received within respective ones of said recessed areas.

* * * * *